US005947779A

United States Patent [19]

Heideman et al.

[11] Patent Number: 5,947,779

[45] Date of Patent: Sep. 7, 1999

[54] PROPULSION DEVICE

[75] Inventors: Torsten Heideman, Grankulla; Isko Kuha, Helsinki; Risto Kurimo, Espoo, all of Finland

[73] Assignee: ABB Azipod Oy, Helsinki, Finland

[21] Appl. No.: 08/911,630

[22] Filed: Aug. 15, 1997

[30] Foreign Application Priority Data

Aug. 16, 1996 [FI] Finland ..... 963230

[51] Int. Cl.[6] ..... B60L 11/02

[52] U.S. Cl. ..... 440/6; 440/58; 440/59; 440/75

[58] Field of Search ..... 440/6, 7, 49, 53, 440/58, 59, 81; 114/150, 151

[56] References Cited

U.S. PATENT DOCUMENTS

| | | | |
|---|---|---|---|
| 3,399,647 | 9/1968 | Alexander, Jr. et al. . | |
| 3,605,678 | 9/1971 | Shimanckas . | |
| 3,654,889 | 4/1972 | Bergstedt . | |
| 3,707,939 | 1/1973 | Berg . | |
| 3,734,050 | 5/1973 | Kitai et al. . | |
| 3,738,306 | 6/1973 | Pinkerton | 440/58 |
| 5,306,183 | 4/1994 | Holt et al. . | |
| 5,445,545 | 8/1995 | Draper | 440/6 |

FOREIGN PATENT DOCUMENTS

| | | |
|---|---|---|
| 0 566 787 | 10/1993 | European Pat. Off. . |
| 75775 | 4/1988 | Finland . |
| 834624 | 8/1988 | Finland . |
| 96590 | 4/1996 | Finland . |
| 34 43 137 | 5/1986 | Germany . |
| 321417 | 3/1970 | Sweden . |

*Primary Examiner*—Stephen Avila
*Attorney, Agent, or Firm*—Smith-Hill and Bedell

[57] ABSTRACT

A main propulsion device of a ship includes a turnable underwater propeller pod, a screw propeller journalled in the propeller pod at one end thereof and a substantially vertical turning shaft journalled at its upper end portion in the ship3 s hull and attached at its lower end portion to the propeller pod. The upper end portion of the turning shaft is offset relative to the lower end portion of the turning shaft perpendicular to the propeller plane toward the propeller.

18 Claims, 4 Drawing Sheets

PROPULSION DEVICE

BACKGROUND OF THE INVENTION

The invention relates to a ship propulsion device.

A traditional ship includes a propulsion propeller and a rudder. Today, there is a trend to use so-called rudder propeller devices of the type described, for example, in Patent Publications DE 26 55 667, SE 412 565, Fl 75128, GB 2 179 312, CA 1,311,657 and U.S. Pat. No. 5,403,216, as the main propulsion means of a ship. A rudder propeller device includes one or several propulsion propellers mounted on a shaft journalled in an underwater housing or pod, which is turnable around a substantially vertical axis. The pod is attached to the lower end of a shaft structure which is turnably journalled in the hull of the ship and is traditionally a straight tubular member. In the following, this shaft structure is called turning shaft. By turning the turning shaft it is possible to direct the pod and thus also the propeller flow in any desired direction. Therefore, a rudder propeller device may also function as the steering device of the ship.

The turning axis of the turning shaft and the pod does not need to be exactly vertical, and it can deviate somewhat from the vertical orientation, for example as described in U.S. Pat. No. 5,403,216.

The steerability of a ship equipped with a rudder propeller device is excellent, but the torque required for turning the pod is high and increases as a function of the propulsion power. The high torque causes problems in particular in slow moving ships with high propeller thrust such as tugs and icebreakers. Problems occur even when the propulsion power per propulsion unit is only some hundreds kilowatts.

Today, the power of a rudder propeller device may be considerable. Rudder propeller devices with a power of more than 20 MW are being designed. In this power class, the torque required for turning the propeller pod reaches high values and thus requires very strong steering machinery, which is a disadvantage.

SUMMARY OF THE INVENTION

The object of the invention is to reduce the torque required for turning the propeller pod of a rudder propeller, so that also a powerful rudder propeller device may be turned by steering machinery of only moderate power.

The invention is based on the observation that the torque required for the turning of a propulsion propeller pod is dependent on the distance of the propeller plane from the turning axis of the pod. Traditionally, the propeller is located at the end of the propeller pod, and hence, is relatively far from the pod's turning axis. Consequently, a relatively high torque is required for turning the pod.

In a ship's main propulsion device in accordance with the invention, the propeller plane is close to the turning axis of the pod and therefore the torque required for steering is relatively small.

The number of propulsion propellers journalled in a propeller pod is preferably one or two. If there are two propellers, it is advantageous that they are mounted axially close to one another at the same end of the propeller pod and are driven to rotate in opposite directions. This improves, as known per se, the propulsion power of the propellers. In this case, one propeller is closer than the other propeller to the propeller pod, and the propeller plane of the one propeller should be close to the turning axis of the pod. The invention will initially be described as a single propeller embodiment.

The invention requires that the turning shaft be configured so that its lower end portion, at which the turning shaft is attached to the propeller pod, is offset from its upper end portion, at which the turning shaft is journalled in the ship's hull, so that the propeller is thereby brought closer to the pod's turning axis than it would be without the offset configuration of the turning shaft. As a result, the turning shaft is not of the traditional straight configuration but has a non-linear, in particular curved or stepped, design. In most cases this leads to the result that the propeller plane is inside the outer circumference of the turning shaft at the level where the turning shaft intersects the hull skin of the ship. The hull skin is the outer surface of the hull around the turning shaft. When this is the case, the distance of the propeller from the pod's turning axis is, as a rule, small enough that only a moderate turning torque is required for turning the propeller pod.

The propulsion propeller may be a pushing or pulling propeller as described in U.S. Pat. No. 5,403,216. The advantage of the invention is greater when the propeller is a pulling propeller because the steering torque required by a pulling propeller is greater in some situations than that required by a pushing propeller. In a single propeller embodiment, it is advantageous that the pod, or at least nearly the entire pod, is at the opposite side of the pod's turning axis from the propeller (which is not considered to be part of the pod). "Nearly the entire pod" means at least 80%, preferably at least 90%, of the length of the pod. If the drive motor of the propeller is in the pod, for instance as described in U.S. Pat. No. 5,403,216, and nearly the entire pod is at the opposite side of the pod's turning axis from the propeller, then the power generating portions of the motor, for example the stator and the rotor of an electric motor, can be at the opposite side of the pod's turning axis from the propeller. Such a design is relatively well balanced also with respect to inertia forces.

The propulsion power delivered by the motor is dependent on the size of the motor. For hydrodynamic reasons, if the motor is in the pod, a large motor diameter is harmful so the propulsion power of the propeller. The size of a motor may be increased also in its longitudinal direction, but that would result in impractical pod dimensions. According to the invention, the drive motor may be divided into two units, one at each side of the propeller. Without increasing excessively the pod's extension from its turning axis, this design gives greater motor power at a given motor diameter. The design is still more advantageous in a twin propeller version, in which the two drive motors are at least substantially symmetrically placed at opposite sides of the two propellers and of the pod's turning axis.

If the propeller pod extends to both sides of the propeller (s), it is of advantage hydrodynamically, that the pod including the propeller hub(s) is formed as a continuous, streamlined body. This is obtained by enlarging the hub portion of each propeller fully or nearly to the same diameter as the pod.

If the propeller(s) be pulling propeller(s), it is important for hydrodynamic reasons that no propeller be too close to the turning shaft. The smallest distance between a pulling propeller and the turning shaft should be at least 10%, preferably at least 15%, of the diameter of the propeller.

For high power propulsion (order of magnitude at least 1 MW per propulsion unit), an electric motor, located in the propeller pod, has proved to be the most advantageous drive motor solution. Other alternatives are hydraulic drive or mechanical power transmission, of which the latter is relatively often used. For mechanical power transmission from a drive motor in the ship to the turnable pod, it is advantageous to design the turning shaft so that at least one linear through-going space is formed therein. A power transmission shaft which is connected to the propeller shaft through an angle transmission may be located in the through-going space. It is particularly easy to arrange the power transmission if the through-going space includes the pod's turning axis, since the power transmission shaft can then be disposed on the turning axis.

BRIEF DESCRIPTION OF THE DRAWINGS

In the following, the invention will be described more in detail with reference to the enclosed drawing, in which FIG. 1 schematically shows a side view of a single propeller embodiment of the invention, FIG. 2 schematically shows a side view of another single propeller embodiment of the invention, FIG. 3 schematically shows a side view of a twin propeller version of the embodiment of FIG. 2, and FIG. 4 schematically shows a side view of another twin propeller version of the embodiment of FIG. 2.

DETAILED DESCRIPTION

Figure 1:
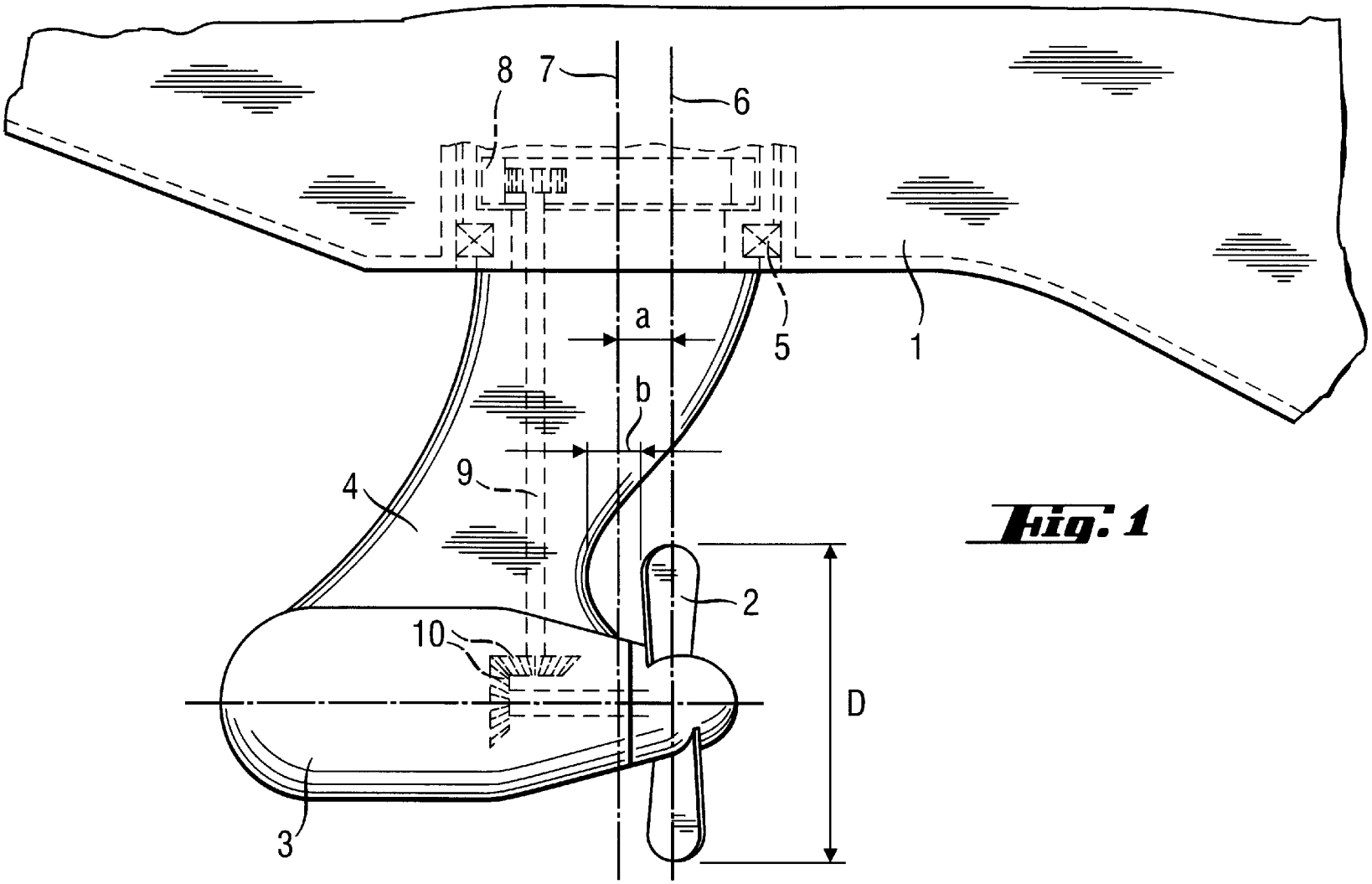

In the drawing, 1 designates a ship's hull, 2 the ship's main propulsion propeller, 3 a propeller pod in which the propeller is journalled and 4 a turning shaft of the propeller pod, which is journalled in an only schematically shown turning bearing 5 in the hull 1. The propeller 2 is shown only schematically and the number of propeller blades is not indicated. The distance a measured along the central axis of the propeller shaft between the propeller plane 6 of the propeller 2 and the pod's turning axis 7 should not be more than 30% of the diameter D of the propeller 2, and is preferably less than 25% of the diameter D. It is still more preferred that the distance a should be less than 20% of the propeller diameter. In FIG. 1, the distance a is about 15% of the diameter D and about 20% of the diameter of the pod's turning bearing 5.

In FIG. 1, a mechanical power transmission to the propeller 2 is schematically outlined. This power transmission includes a driven gear ring 8, a vertical power transmission shaft 9 and bevel gear wheels 10, through which the driving power is transmitted to the propeller 2. The pod's turning shaft 4 includes a vertical linear unobstructed space of such dimensions that it is possible to locate the power transmission shaft 9 therein.

The bending stress applied to the turning shaft by the propulsion thrust of the propeller is dependent basically on the cross-sectional area of the turning shaft and on the distance from the propeller shaft. In the event that the propeller plane is substantially parallel to the pod's turning axis, the propeller plane 6 should intersect the turning shaft at or below the level at which the bending stress is at a maximum, which is normally the level at which the turning shaft meets the hull.

In the embodiment of FIG. 1, the propeller plane 6 of the propeller 2 intersects the pod's turning shaft 4 below the level of the hull 1. Nearly the entire propeller pod 3 is at the opposite side of the pod's turning axis 7 from the propeller 2.

It is preferred that the mechanical transmission of FIG. 1 be replaced by an electric drive including an electric motor in the propeller pod 3, since this avoids difficulty arising from power transmission shaft 9 through several gear drives. In this case, preferably the entire motor, or at least the rotor and the stator of the motor, would be at the opposite side of the pod's turning axis 7 from the propeller 2.

In the embodiment of FIG. 1, the propeller is a pulling propeller. In that case, the smallest distance between the propeller, in particular close to the tips of the propeller blades, and the turning shaft 4 must not be too small in order to ensure that the turning shaft does not interfere with the propeller flow to an unacceptable extent. In the figure, the axial distance b between the propeller and the turning shaft is approximately 15% of the diameter D of the propeller 2.

Figure 2:
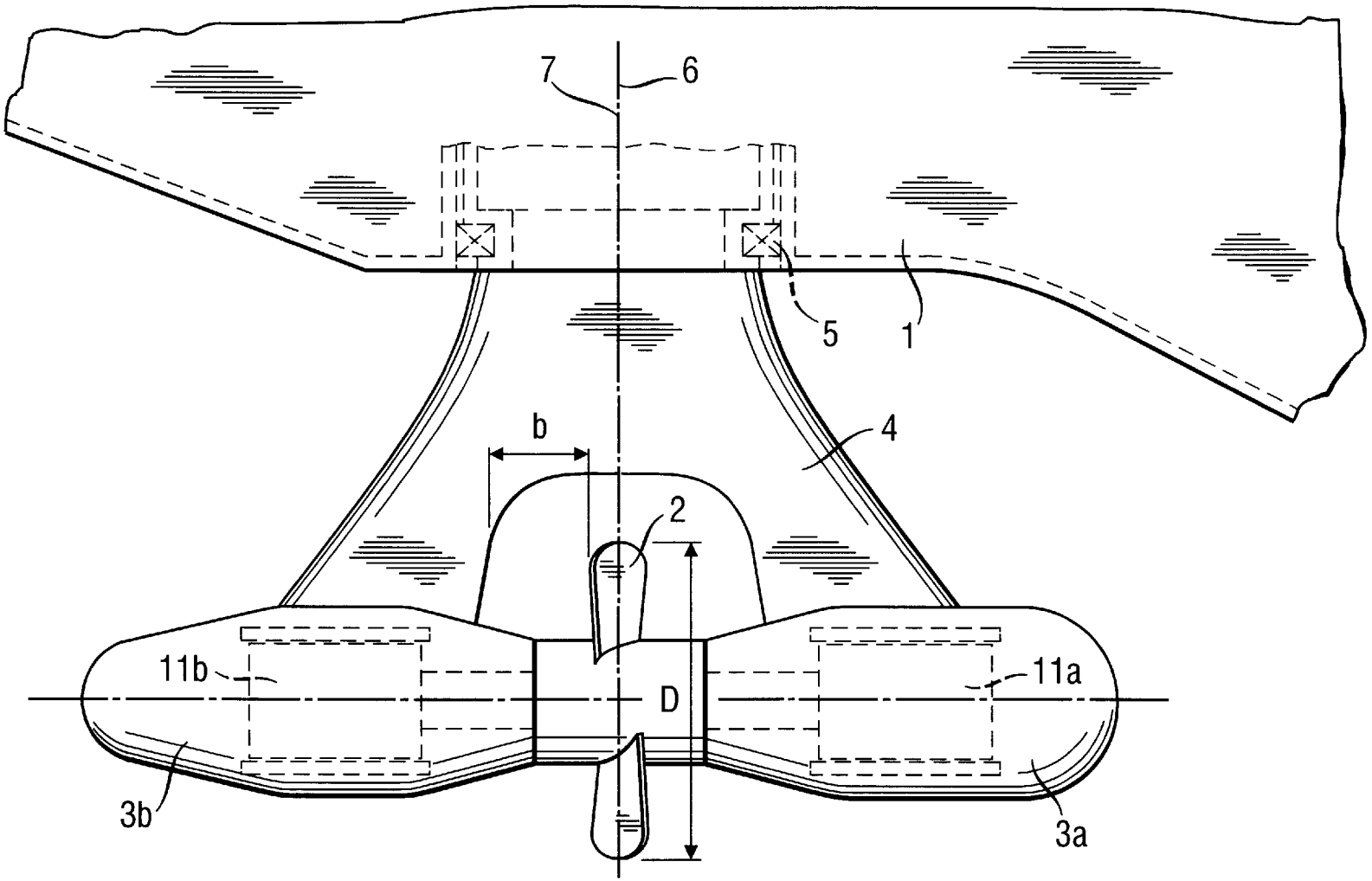

In the embodiment of FIG. 2. the propeller pod is divided into two portions 3*a* and 3*b*, of which portion 3*a* is in front in the ship's normal direction of movement. The propeller 2 is powered by two schematically shown electric motors 11*a* and 11*b*. This arrangement gives the advantage that with a relatively small motor diameter a great power output is obtained, because the total axial length of the motor units is considerable.

In the embodiment of FIG. 2, the propeller plane 6 of the propeller 2 lies in the pod's turning axis 7. The distance b between the propeller 2 and the closest portion of the turning shaft 4 behind it, can, in this embodiment, be made considerably greater than in the embodiment of FIG. 1.

Figure 3:
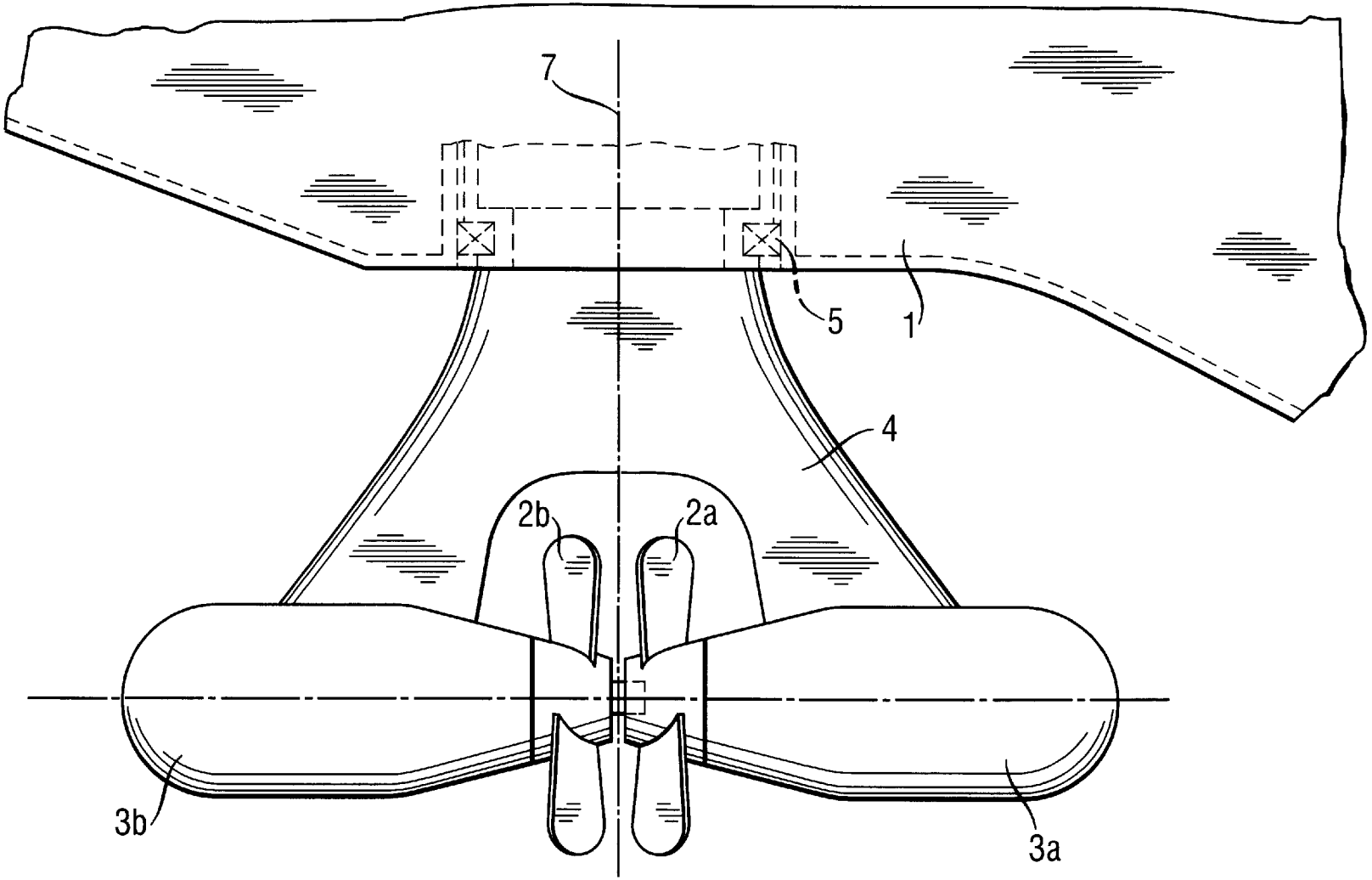

In the embodiment of FIG. 3, the structure is in principle the same as in FIG. 2, but here two propulsion propellers 2*a* and 2*b*, which rotate in opposite directions, are used. In this way, a given motor power gives a greater propulsion power. The improvement may reach nearly 20%.

Figure 4:
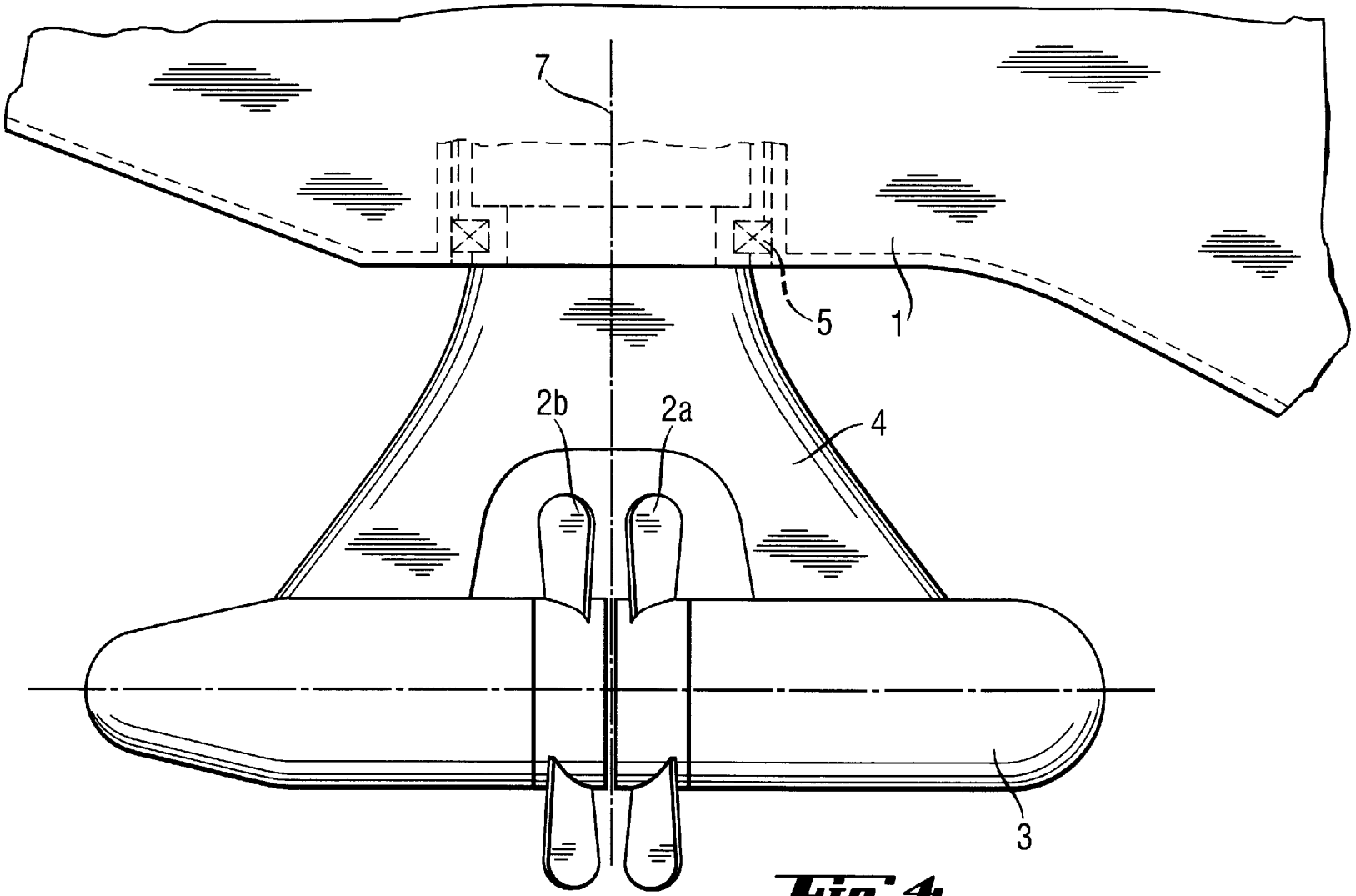

In the embodiment of FIG. 4, the design of FIG. 3 is developed further. The hubs of the propellers are enlarged so that the propeller pod forms a continuous cigar-shaped body. This design usually requires that the external diameter of the propellers is slightly enlarged.

The invention is not restricted to the embodiments shown but several modifications thereof are feasible within the scope of the following claims.

We claim:

1. A main propulsion device of a ship including a turnable underwater propeller pod having first and second opposite ends, a screw propulsion means journalled in the propeller pod at the first end thereof, and a substantially vertical turning shaft having an upper end portion at which it is journalled in the ship's hull and lower end portion attached to the propeller pod, the turning shaft having a turning axis and defining at least one unobstructed rectilinear passage opening into the pod, and the lower end portion of the turning shaft being offset relative to the turning axis of the turning shaft in the direction from the first end of the propeller pod toward the second end of the propeller pod.

2. A propulsion device according to claim 1, wherein the screw propulsion includes a propeller having a propeller plane and a rotation axis, and a plane which is parallel to the turning axis and intersects said rotation axis at a point where the propeller plane of said propeller intersects said rotation axis, intersects the turning shaft at or below the level at which the bending stress applied to the turning shaft by the propulsion thrust of the screw propulsion means is at a maximum.

3. A propulsion device according to claim 1, wherein the screw propulsion means comprises a single propeller at one end of the propeller pod, the propeller having a propeller plane which is at the opposite side of the pod's turning axis from substantially the entire propeller pod.

4. A propulsion device according to claim 3, wherein the propeller pod contains a drive motor coupled to the screw propulsion means and the propeller plane and the drive motor are at opposite respective sides of the pod's turning axis.

5. A propulsion device according to claim 3, wherein the propeller pod contains an electric motor having a shaft connected to the screw propulsion means, the electric motor includes a stator and a rotor, and the stator and rotor are at the opposite side of the turning axis from the propeller plane.

6. A propulsion device according to claim 1, wherein the pod is composed of first and second pod units which are axially aligned with the screw propulsion means therebetween and wherein each pod unit contains a means for transmitting power to the screw propulsion means.

7. A propulsion device according to claim 6, wherein the screw propulsion means comprises a single propulsion propeller.

8. A propulsion device according to claim 1, wherein the screw propulsion means comprises two coaxial propulsion propellers mounted axially close together and of opposite hand.

9. A propulsion device according to claim 1, wherein the screw propulsion means is driven as a pulling propeller and the minimum distance between the screw propulsion means and the turning shaft is at least 10% of the diameter of the screw propulsion means.

10. A propulsion device according to claim 1, comprising an electric motor located inside the propeller pod and coupled drivingly to the screw propulsion means.

11. A propulsion device including according to claim 1, wherein the screw propulsion means includes a propeller having a propeller plane and a rotation axis and the distance of the propeller plane from the turning axis of the turning shaft measured along the rotation axis of the propeller is less than 30% of the diameter of the propeller.

12. A propulsion device according to claim 11, wherein said distance is less than 25% of the diameter of the propeller.

13. A propulsion device according to claim 11, wherein said distance is about 15% of the diameter of the propeller.

14. A main propulsion device of a ship including a turnable underwater propeller pod comprising first and second pod units in substantial axial alignment, a substantially vertical turning shaft attached at its lower end to the propeller pod and journalled at its upper end in the ship's hull for turning the propeller pod around a turning axis, and a screw propulsion means journalled in the propeller pod between the first and second units substantially at the position of the turning axis of the turning shaft.

15. A propulsion device according to claim 14, wherein the turning shaft includes a first leg attached to said first unit and a second leg attached to said second unit and the screw propulsion means is disposed between said first and second legs.

16. A propulsion device according to claim 14, wherein the first and second units contain first and second electric motors respectively, said first and second electric motors being connected to the screw propulsion means.

17. A propulsion device according to claim 16, wherein said screw propulsion means comprises first and second coaxial propulsion propellers of opposite hand and the first and second electric motors are connected to the first and second propellers respectively for driving them in opposite respective directions.

18. A propulsion device according to claim 14, comprising first and second rotational drive mechanisms mounted in the first and second pod units respectively.

* * * * *